US005954024A

United States Patent [19]

Duhr et al.

[11] Patent Number: 5,954,024

[45] Date of Patent: Sep. 21, 1999

[54] METHOD FOR IGNITION CONTROL IN COMBUSTION ENGINES

[75] Inventors: Joel Duhr, Leudelange, Luxembourg; Anders J Göras, Åmål, Sweden

[73] Assignee: Henkel Corporation, Gulph Mills, Pa.

[21] Appl. No.: 09/011,896

[22] PCT Filed: Jun. 20, 1996

[86] PCT No.: PCT/SE96/00816

§ 371 Date: Feb. 19, 1998

§ 102(e) Date: Feb. 19, 1998

[87] PCT Pub. No.: WO97/48905

PCT Pub. Date: Dec. 24, 1997

[51] Int. Cl.[6] ..... F02P 15/02

[52] U.S. Cl. ..... 123/310; 123/406.26

[58] Field of Search ..... 123/310, 406.26, 123/406.27; 73/35.08

[56] References Cited

U.S. PATENT DOCUMENTS

| | | | |
|---|---|---|---|
| 4,377,140 | 3/1983 | Latsch | 123/415 |
| 4,648,367 | 3/1987 | Gillbrand et al. | 123/406.26 |
| 5,003,945 | 4/1991 | Hoeptner | 123/310 |
| 5,087,882 | 2/1992 | Iwata | 123/406.26 |
| 5,327,864 | 7/1994 | Regueiro | 123/310 |

FOREIGN PATENT DOCUMENTS

| | | |
|---|---|---|
| 4009305 | 9/1991 | Germany . |

OTHER PUBLICATIONS

Patent Abstracts of Japan, vol. 7, No. 44, M–195 abstract of JP,A,57–193777 (Nissan Jidosha K.K.), Nov. 29, 1982.

*Primary Examiner*—John Kwon

*Attorney, Agent, or Firm*—Ernest G. Szoke; Wayne C. Jaeschke; Norvell E. Wisdom

[57] ABSTRACT

This invention relates to a method applied in combustion engines having two spark plugs in each combustion chamber for controlling ignition and ionization current measurements, one of the spark plugs acting as a sensor for the ionization current measurements. The ignition voltage supplied to each of the spark plugs in a chamber is controlled such that the spark duration of the spark plug acting as the sensor is less than 50% of the other spark plug in the chamber.

10 Claims, 4 Drawing Sheets

METHOD FOR IGNITION CONTROL IN COMBUSTION ENGINES

The present invention relates to a method for controlling ignition and ionisation current measurements in a combustion engine.

BACKGROUND OF THE INVENTION

It is known to use ionic current sensors in order to monitor the combustion process in combustion engines. This type of sensing technique has been implemented in Otto-engines, using the existing spark plug as sensor. As disclosed in U.S. Pat. No. 4,648,367, a ion current sensing circuit is arranged in the ground connection of the primary winding of the ignition coil, using the spark plug gap as the sensor element.

In the ion-sensing system mentioned above, the spark plug is used as an actuator as well as a sensor. The actuator function is initiated at generation of the spark, and the sensor function is initiated shortly thereafter. These two functions can not be initiated simultaneously, because the spark discharge interferes with ionization current measurements within the combustion chamber.

It is known to use additional measuring gaps integrated in the spark plug. As disclosed in U.S. Pat. No. 5,180,983 and JP,A,57202078, besides the conventional spark gap the spark plug is equipped with an additional measuring gap. This type of spark plug is capable of detecting the ionization current without adverse effects of noise generated at the ignition. However, this type of spark plug is rather expensive. The spark plug is a disposable article of consumption, which brings operation costs up.

Another concept is known having additional measuring gaps located at a distance from the spark plug. As disclosed in U.S. Pat. No. 5,036,669; U.S. Pat. No. 4,665,737; U.S. Pat. No. 4,377,140; U.S. Pat. No. 4,304,203; U.S. Pat. No. 4,308,519 and DE,A,3833465 an additional measuring gap or a number of measuring gaps can be arranged at a distance from the spark plug. These types of systems require at least one extra sensor element, either an additional spark plug which is only used as sensor or additional measuring gaps integrated in the cylinder head gaskets or other engine parts.

A conflict arises when using the spark plug gap of a conventional spark plug as a common actuator and sensor at highly diluted air-fuel mixtures, for example during high EGR-ratios and/or lean burn control at lambda values in the range $\lambda$=1.2–1.4, or above. In order to maintain a stable combustion at high dilution ratios, more ignition energy is needed. A concept used is the so called configurable spark, having a configurable spark duration. A spark duration up to 3 ms is beneficial for a stable combustion during high diluted air-fuel ratios. However, due to the sequential nature of function between the actuator phase and the sensing phase, the spark duration should be restricted to not more than 0.5 ms at high engine speed. The spark phase must have attenuated properly before any ion current measurements can be made. An ignition coil having low impedance is preferable, where the coil ringing is of short duration not interfering with the ion current measurements.

The spark duration limits for an engine where a knocking condition is detected through ion current measurements at the spark plug gap could be as follows. If the engine is operating at 6000 rpm, having an ignition timing at 20 Crankshaft Degrees (=CD) before Top Dead Centre (=TDC) and where a knocking combustion typically starts 17–20 CD after TDC, then the spark phase should have a duration shorter than 1.12 ms. At lower engine speeds successively longer spark duration are allowable. At 3000 rpm a spark duration up to 2.24 ms is allowable, assuming the same conditions as of ignition timing and occurrence of a knocking combustion.

During some operating conditions the knocking condition can occur during a long period or a large crank angle from 17 CD up to 50 CD. In those cases the arc duration can be extended further. Operating the engine at high diluted air-fuel ratios is necessary in order to meet future requirements of low emission levels and fuel consumption.

SUMMARY

An object of the invention for combustion engines having at least two spark plugs per combustion chamber is to combine the possibility of obtaining ionisation measurements via at least one spark plug gap, while at the same time being able to deliver sufficient ignition energy for a stable combustion at high dilution ratios of the air-fuel mixture.

Another object for combustion engines having at least two spark plugs per combustion chamber is to enable longer spark duration at both spark plugs during critical operating conditions with high EGR-rates, which EGR-mode is initiated only during certain parts of the operating range of the engine, especially during part load and low to medium speed ranges. EGR is often initiated during so called constant road-load, during a so called steady-state operation, where the load upon the engine is less than 50%. A steady-state operation corresponds to an operation case where a vehicle driven by the engine is running at constant speed, at highway speed limit of approximately 90 km/h, and on a substantially horizontal road, where the engine is not subjected to transient load- or speed conditions.

Yet another object is to enable proper measurements of the ion signal properties at the very early part of the ion current trace, for other combustion related feedback, during a wider operating range of the engine.

The foregoing and other objects are accomplished in accordance with certain features of the present invention by controlling the ignition supply to the spark plug in each combustion chamber acting as a sensor for ionization current measurement such that, during at least a part of the operating range of the engine, the duration of the ignition spark of the spark plug acting as the sensor is less than 50% of the spark duration of the other spark plug in the combustion chamber.

By using a different and shorter spark duration at the spark plug acting as a sensor, initiation of ignition can be obtained at multiple locations in the combustion chamber at a wide operating range of the engine. This enhances a successful initiation of combustion particularly at high diluted air-fuel mixtures, where inhomogenous mixtures could cause different ability to ignite at different locations in the combustion chamber.

Other distinguishing features of the invention are evident from the characterising part of other claims and the following description of preferred embodiments, which description is made by reference to figures specified in the following list of figures.

DETAILED DESCRIPTION OF PREFERRED EMBODIMENT(S)

The ignition coil is designed for spark duration which is regarded necessary to operate the engine under high dilution ratios with a stable combustion. Typical values are between 0.8 to 3 ms depending on the combustion chamber, intake system and spark plug design. This duration does not interfere with the ion sensing process at low speed and/or large ignition timing advance.

Large timing advance is often initiated at high Exhaust Gas Recirculation (EGR) rates. EGR is used to reduce emission levels of especially $NO_x$ as well as fuel consumption, and managed with external or internal recirculation. It is to be noted that with increased EGR rates, the risk of engine knocking is decreased.

Depending on the spark duration and burn rate of the combustion within the combustion chamber a threshold can be determined dependent of at least engine speed, above this threshold the ion sensing process could lose important information from the ion current signal.

Figure 1:
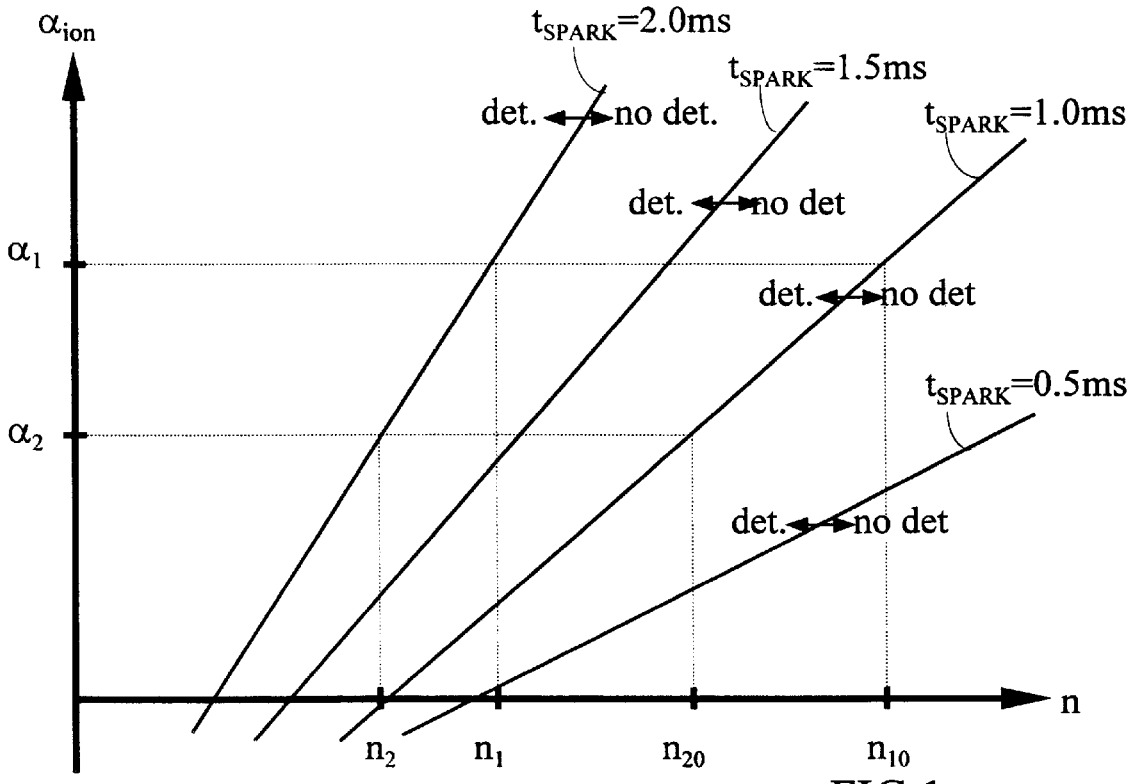
FIG. 1 shows a graph illustrating when detection of ionisation current could be made for different duration of the ignition spark, versus ignition advance and engine speed.

FIG. 1 shows a graph illustrating when a correct detection of a knocking condition can be made using the ionisation current, for different duration of the ignition spark ($t_{SPARK}$) versus ignition advance ($\alpha_{ION}$) and engine speed (n). If the ignition coil or control of a configurable spark results in a spark duration of 2 ms, then the maximum engine speed allowable will be $n_1$ when a spark advance of $\alpha_1$ is in effect. If a spark advance of $\alpha_2$ is in effect, and $t_{SPARK}$=2 ms, then the maximum allowable engine speed will be set to $n_2$.

If the ignition coil or control of a configurable spark instead results in a spark duration of 1 ms, then the maximum engine speed allowable will increase to $n_{10}$ when a spark advance of $\alpha_1$ is in effect. If a spark advance of $\alpha_2$ is in effect, and $t_{SPARK}$=1 ms, then the maximum allowable engine speed will be set to $n_{20}$.

The operating limits for each spark duration, $t_{SPARK}$, can be established for each type of engine design using following equation:

$$\alpha_{ION}=n*360*t_{SPARK}-\beta_{ION},$$

where $\alpha_{ION}$ is the minimum spark advance, in crank shaft degrees before Top Dead Centre, n is the engine speed, measured in revolutions per second, $t_{SPARK}$ is the spark duration including coil ringing (i.e. the attenuation time), measured in seconds and $\beta_{ION}$ is the crankshaft position where ionisation current detection is initiated.

Figure 2:
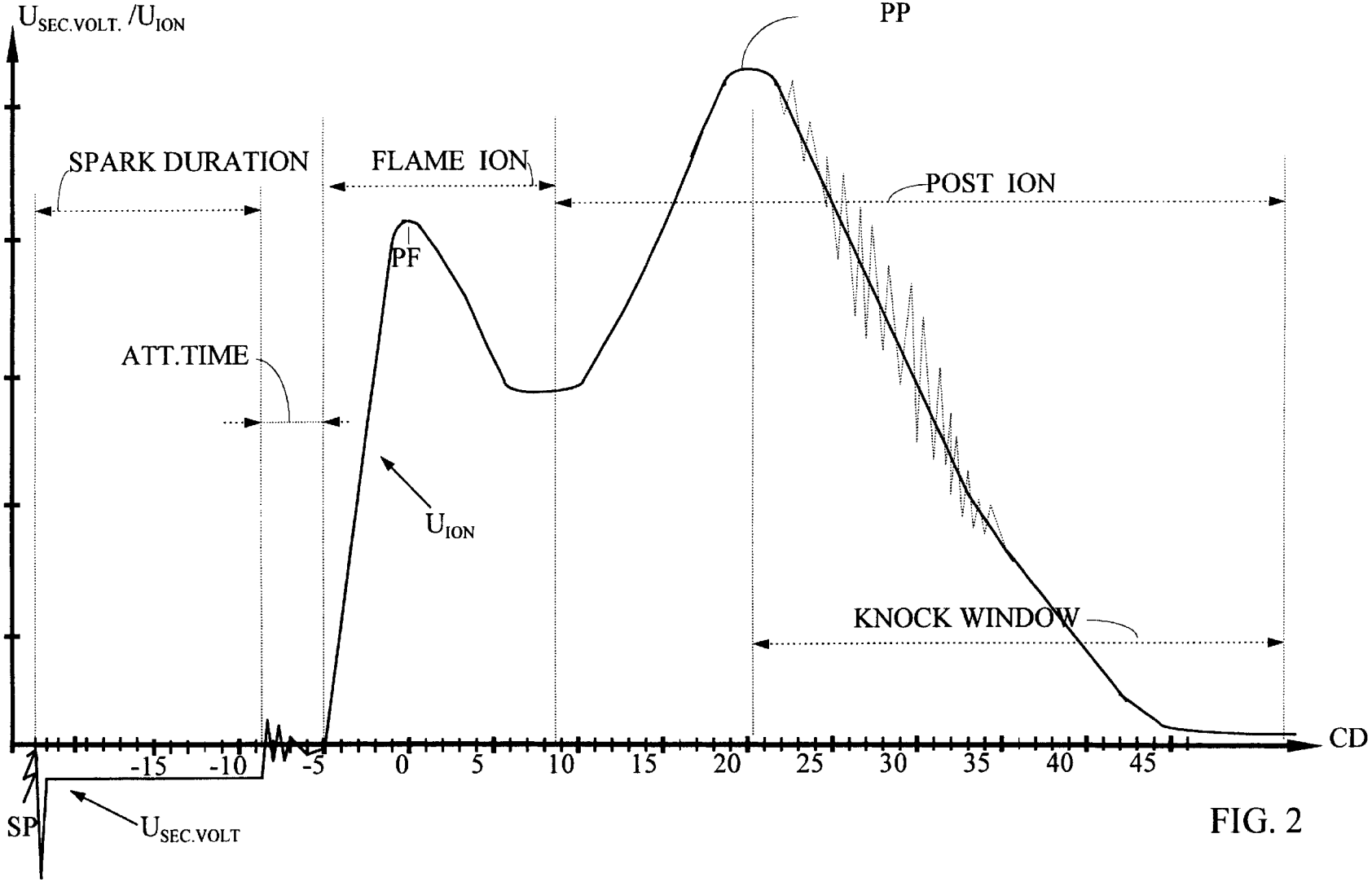
FIG. 2 shows a graph illustrating the secondary voltage and the ionic current as a function of crankshaft degrees.

In FIG. 2 a typical ion current signal $U_{ION}$ is shown schematically, as obtained with a measuring arrangement later described in detail and shown in FIG. 3. The signal level $U_{ION}$ measured in volt is shown at the Y-axis, and the output signal can lie in the range 0–2.5 volt The X-axis is shown in Crankshaft Degrees, CD, where 0° denotes the top dead centre position when the piston is occupying its uppermost position.

The position SP, primarily dependent of engine load and rpm, is a position before the top dead centre in order to locate the peak combustion pressure preferably 12–20 crankshaft degrees after top dead centre. $U_{SEC.VOLT}$ show the ignition voltage as measured in the spark plug gap. It is to be noted that the voltage levels of $U_{SEC.VOLT}$ and $U_{ION}$ are not proportional to each other, and they are only shown in FIG. 2 in order to show the sequential order of appearance in time, i.e. crankshaft degrees CD. The break down voltage needed to establish the spark, the first negative peak after SP, is in the order of some tens of kVolts, and after the break down phase an ignition voltage is maintained in the order of 500–2000 Volts during the glow phase in which the systems dumps the remaining electrical energy stored in the ignition coil through the spark plug gap into the air/fuel mixture. Between the break down phase and the glow phase exists also an arc phase of short duration (not shown) during which arc phase a lower voltage is developed.

The spark is established and maintained during these phases, denoted SPARK DURATION in FIG. 2. When the spark is terminated an attenuation phase, denoted ATT. TIME in FIG. 2, will follow, where the ignition coil starts ringing. The length of this attenuation phase and the frequency of the coil ringing is dependent of the ignition coil design.

Coil ringing occurs when the remaining energy of the coil is insufficient in order to maintain the spark. When the spark goes out, i.e. when the current in the secondary winding is interrupted, then an induced voltage will occur in the primary winding. This process starts a oscillating process between the primary winding and the secondary winding, which ends when the residual energy in the coil has dissipated completely.

Figure 3:
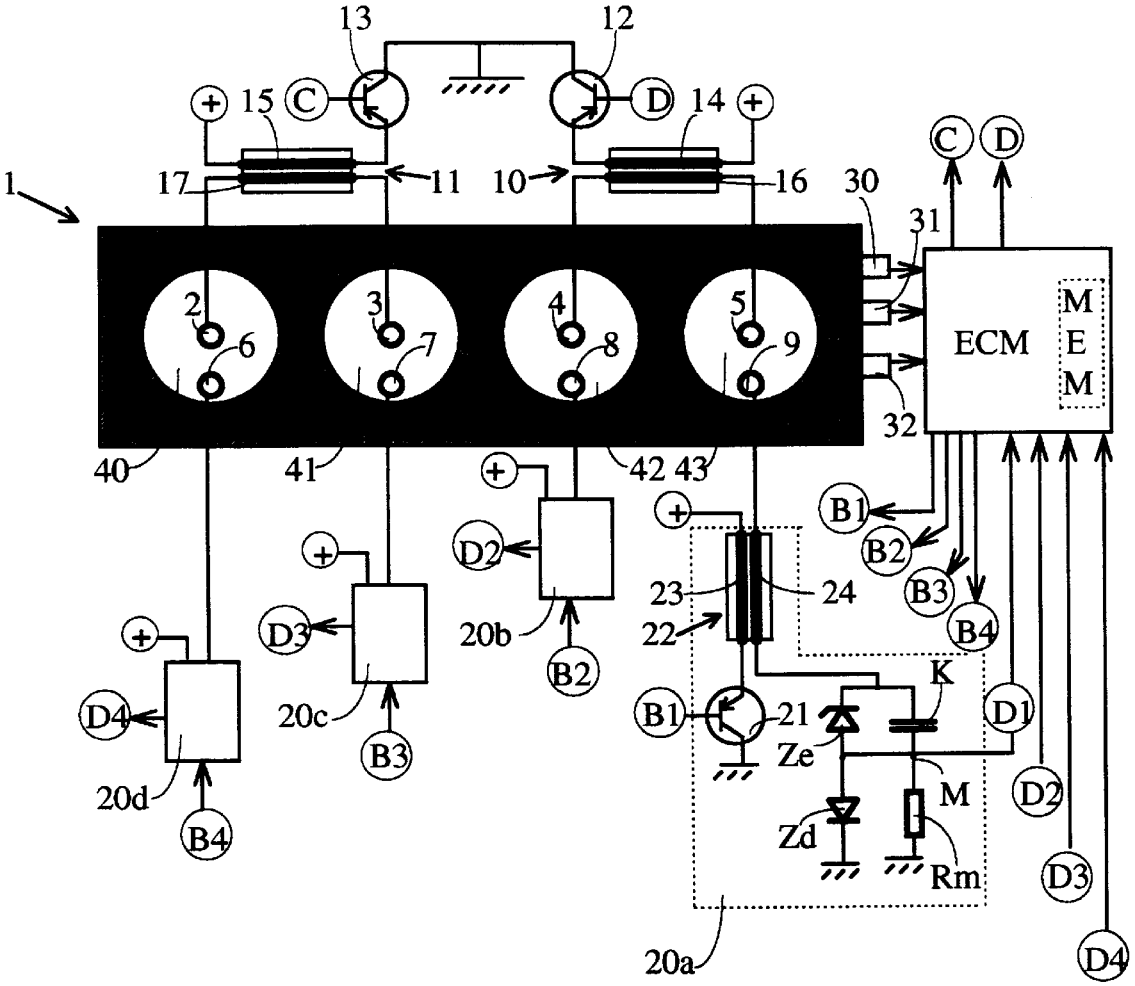
FIG. 3 shows a first embodiment of an ignition system capable of being operated according to the inventive method.

The collection of measured values is preferably controlled by an Engine Control Module, ECM in FIG. 3, in such a way that the ECM only reads the signal input, D1, D2, D3 or D4, at certain engine positions or at certain points of time, i.e. in defined measuring windows. These measuring windows are activated preferably dependent of the ignition timing SP, in order for these measuring windows to be opened a sufficiently long time after the spark discharge having attenuated properly.

After the ignition generation phase the flame ionisation phase is initiated, in FIG. 2 denoted FLAME ION, during which phase the measuring voltage is affected by the establishment of a burning kernel of the air/fuel mixture in or near the spark plug gap.

After the flame ionisation phase the post ionisation phase is initiated, in FIG. 2 denoted as POST ION, during which phase the measuring voltage is affected by the combustion within the combustion chamber, which combustion causes an increase of the number of ionising particles at increasing temperature and combustion pressure. The typical behaviour is that a maximum value, denoted as PP in FIG. 2, is reached during POST ION when the combustion pressure has reached its maximum value and the flame front has reached the walls of the combustion chamber, which causes an increase in pressure. A knocking condition can occur after PP at the negative slope of the ionisation curve, and result in a superposed frequency in the range of 7 kHertz in a 0.5 liter combustion chamber. A knocking condition is shown by the dotted part of $U_{ION}$ in FIG. 2 at the negative slope after PP.

In order to be able to detect a knocking condition or any other early combustion related curve properties, it is essential that the ignition spark has attenuated properly. The coil ringing should not interfere with the measuring window for knock detection. This is especially critical if the coil ringing has the same frequency as the knocking frequency.

First Embodiment

In FIG. 3 is shown a first embodiment which can be operated according the inventive method. The engine 1 shown is a four cylinder engine, with combustion chambers 40, 41, 42 and 43. Each combustion chamber having two spark plugs 2/6, 3/7, 4/8 and 5/9. One spark plug 2–5 in each combustion chamber is connected to one end of a dual ended ignition coil 10, 11, of the so called waste spark type. The dual ended ignition coil is characterised by having one end of the secondary winding 16, 17 connected to one spark plug, and the other end connected to another spark plug preferably arranged in another combustion chamber. This results in the ignition voltages in the spark plug gaps connected at opposite ends of the secondary winding having reversed polarities. Both sparks being generated essentially simultaneously. In a four cylinder engine this would lead to one spark could be generated at the ignition timing event (SP), while the other spark is generated at a moment in the operation cycle where it is not needed in order to ignite an air-fuel mixture, and this is why this system also is called the waste-spark type.

The generation of spark is controlled in a conventional manner by a switch 12, 13, operated by the Engine Control Module, ECM, dependent of present operating parameters detected by at least an engine speed sensor 30, an engine temperature sensor 31 and an engine load sensor 32. The ECM controls the conductive state of the switches 12 and 13 via control signals D and C respectively. Another spark plug in each combustion chamber is connected to a ion-sense ignition module 20*a*, 20*b*, 20*c* and 20*d*.

The ignition voltage in the ion-sense module 20*a*, 20*b*, 20*c* or 20*d*, is generated in an ignition coil 22, having a primary winding 23 and a secondary winding 24. One end of the primary winding 23 is connected to a voltage source +, preferably from a battery (not shown), and the other end is connected to ground via an electrically controlled switch 21.

A current starts to flow through the primary winding 23 when the control signal B1 from the ECM activates the switch 21 to a conductive state. When the current through the primary winding 23 is interrupted a step-up transformation of the ignition voltage will be obtained in the secondary winding 24 of the ignition coil 22 in a conventional manner, and an ignition spark will be generated in the gap of the spark plug 9.

Start and stop of the current flow, so called dwell-time control, is controlled dependent of the present parameters of the engine and according a pre-stored ignition map in the memory MEM of the ECM. Dwell-time control ensures that the primary current reaches the level necessary and that the ignition spark is generated at the ignition timing necessary for the present load case.

One end of the secondary winding 24 is connected to the spark plug 9, and the other end connected to ground includes a detector circuit detecting the degree of ionization within the combustion chamber. The detector circuit includes a voltage accumulator, here in form of chargeable capacitor K, which capacitor biases the spark gap of the spark plug with a substantially constant measuring voltage. The capacitor is equivalent to the embodiment shown in EP,C,188180, where the voltage accumulator is a step-up transformed voltage from the charging circuit of a capacitive type of ignition system. In the embodiment shown in FIG. 3, the capacitor K is charged when the ignition pulse is generated, to a voltage level given by the break-down voltage of the zener diode Ze. This break-down voltage could lie in the interval between 80–400 volts. When the stepped up ignition voltage of about 30–40 kVolts is generated in the secondary winding, the zener diode Ze break down which assures that the capacitor K will not charged to a higher voltage level than the break-down voltage of the zener diode Ze. In parallel with the measuring resistance Rm is a protecting diode Zd connected with reversed polarity, which in a corresponding manner protects against over voltages of reversed polarity.

The current in the circuit 9–24-K/K-Rm-ground can be detected at the measuring resistance Rm, which current is dependent of the conductivity of the combustion gases in the combustion chamber. The conductivity in turn is dependent of the degree of ionisation within the combustion chamber.

By the measuring resistance Rm being connected close to ground only one connection to the measuring point M is necessary for obtaining the ionisation signal D1. The ionisation signal, D1, is characteristic for the degree of ionisation within the combustion chamber. By analysing the current, alternatively the voltage, through the measuring resistance Rm could among others a knocking condition or preignition be detected. As been mentioned in U.S. Pat. No. 4,535,740 also during certain operating cases the present air-fuel ratio can be detected, by measuring how long the ionisation current is above a certain level.

Only one ion-sense ignition module 20*a* is shown in detail, and the other ion-sense modules 20*b*, 20*c* and 20*d* are identical with the ion-sense module shown in 20*a*. These other ion-sense modules are controlled in a similar manner with individual control signals B2, B3 and B4 from the ECM, and ionisation signals D2, D3, and D4 are obtained from each combustion chamber.

Operation of first embodiment, first mode of operation

In the first embodiment shown, for the first mode of operation, the dual-ended coils are designed and optimised for delivery of highest possible ignition energy. The spark duration obtained from the dual-ended coils 10, 11 can preferably be in the order of 1–3 ms during the entire operating range of the engine. The spark duration obtained from the ion-sense modules 20*a*–20*d* can preferably be in the order of 0.5 ms.

The system shown in the first embodiment in the first mode of operation is designed for a non configurable spark duration, where each dual-ended coil is designed for the worst operating case, i.e. high diluted air-fuel mixtures, while the spark produced from the ion-sense modules are design not to interfere with the knock-window during the entire operating range of the engine, especially the upper engine speed range. The essential feature is that the spark duration of the ignition spark obtained from the ion-sense modules is less than 50% of the spark duration of the other spark obtained from the dual ended coils.

Operation of first embodiment, second mode of operation

In the first embodiment shown, for the second mode of operation, the dual-ended coils are designed for delivery of a configurable spark. The spark duration obtained from the dual-ended coils 10, 11 can preferably be configurable in the order of 0.5–3.0 ms during the entire operating range of the engine. The spark duration obtained from the ion-sense modules 20*a*–20*d* can preferably be substantially constant in the order of 0.5 ms.

By this way of operation at least one spark plug can always deliver the amount of ignition energy needed for a reliable onset of combustion, i.e. during high diluted air-fuel mixtures. The spark plug acting as a ionisation sensor, supports delivery of ignition energy, but only to the extent not to interfere with ionisation current measurements.

Operation of first embodiment, third mode of operation

In the first embodiment shown, for the third mode of operation, the dual-ended coils are designed and optimised for delivery of highest possible ignition energy. The spark duration obtained from the dual-ended coils 10, 11 can preferably be in the order of 1–2 ms during the entire operating range of the engine. The spark duration obtained from the ion-sense modules 20*a*–20*d* can preferably be in the order of 0.5 ms during single spark operation, i.e. if for example the switch 21 is only switched between a conductive and non-conductive state once per working cycle.

Each ion-sense module serving one of the spark plugs 6–9 in a combustion chamber 20*a*–20*d* is modified for a configurable spark operation.

A configurable spark can be obtained by modification of the ion-sense module in the same manner as described in SE,A,9600460-1, which by using a variable zener voltage Ze with higher breakdown voltage in the order of 1–2 kVolts during the sparking phase, obtains a sustained spark having an AC-characteristic, by repeatedly switching the switch 21 between a conductive and non-conductive state. A configurable spark can alternatively be obtained by modification of the ion-sense module in the same manner as shown in SE,A,9403463-4.

The ion-sense modules 20*a*–20*d* having configurable spark can then be operated such that the spark duration is 2 ms, from the ion-sense module serving a combustion chamber, in the operating range defined in FIG. 1 on the left hand side of the operating limit indicated by $t_{SPARK}$=2.0 ms. The ion-sense module for successively higher engine speeds is operated such that the spark duration decreases with at least increase in engine speed, but preferably also with decreasing ignition advance $\alpha_{ion}$. For the operating range between the operating limit indicated by $t_{SPARK}$=2.0 ms and the operating limit indicated by $t_{SPARK}$=1.5 ms, a constant spark duration of 1.5 ms can be obtained, or alternatively a proportional reduction of the spark duration when approaching the limit $t_{SPARK}$=1.5 ms.

The operating limits are all stored in the memory of the ECM and controlled depending upon at least the present engine speed n detected from the engine speed sensor 30.

Second Embodiment

Figure 4:
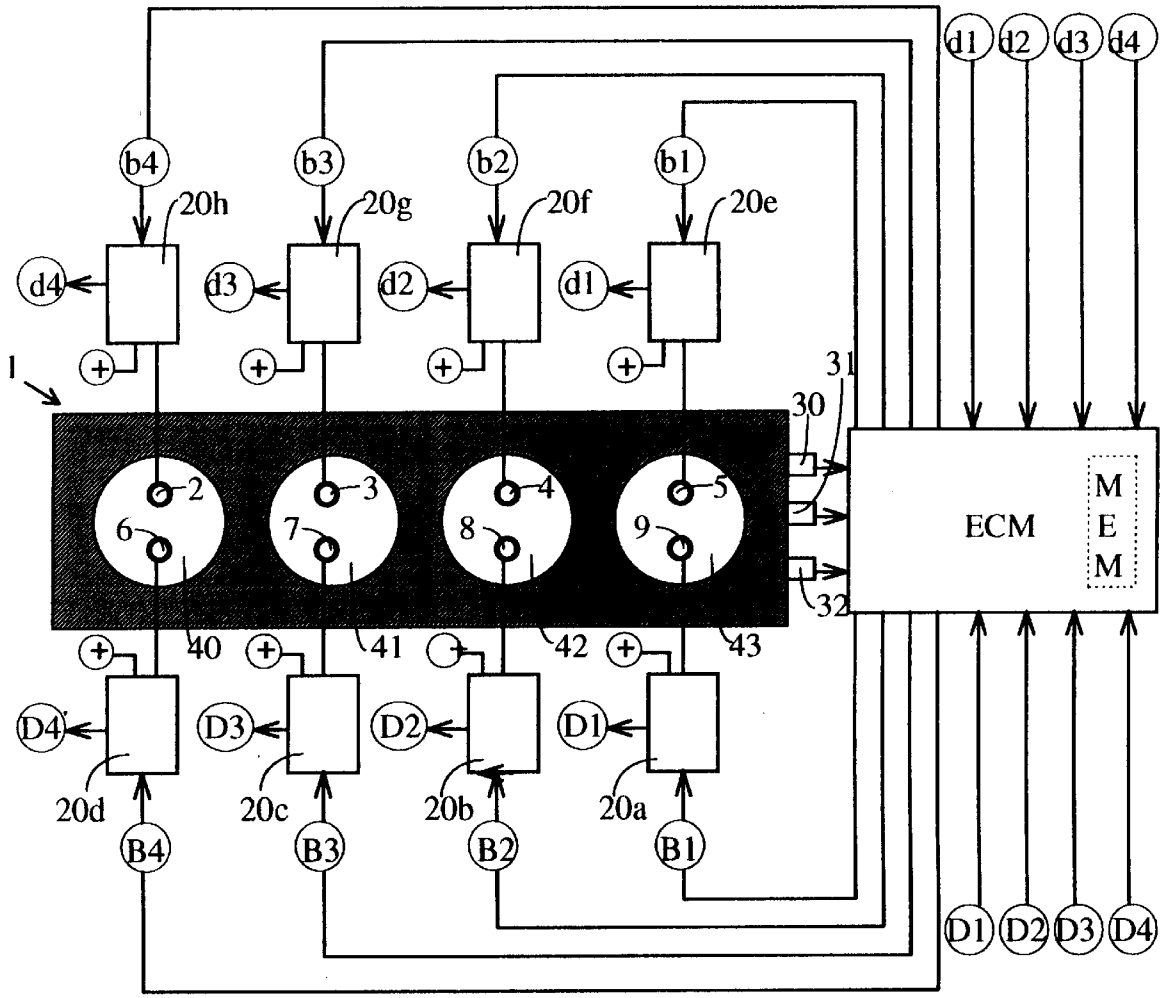
FIG. 4 shows a second embodiment of an ignition system capable of being operated according to the inventive method.

In FIG. 4 is shown a second embodiment which can be operated according the inventive method. A four cylinder engine 1, with combustion chambers 40, 41, 42 and 43 is shown in FIG. 4, with modules and details identical to those shown in FIG. 3 given the same reference numbers. The dual ended coils shown in FIG. 3 are in this embodiment substituted by ion-sense modules 20*e*, 20*f*, 20*g* and 20*h*, all being identical with the ion-sense module 20*a* shown in detail in FIG. 3.

These substituting ion-sense modules 20*e*, 20*f*, 20*g* and 20*h*, are controlled in a similar manner with individual control signals b1, b2, b3 and b4 from the ECM, and ionisation signals d1, d2, d3, and d4 are obtained from each combustion chamber.

Operation of second embodiment, first mode of operation

In the second embodiment shown, for the first mode of operation thereof, each ion-sense module is designed for delivery of an ignition spark having short duration, preferably with an ignition coil having low impedance. The spark duration obtained from a single sparking mode, can preferably be in the order of 0.5 ms or less. Each module 20*a*–20*h*, or only those modules serving one of the spark plugs in a combustion chamber 20*a*–20*d* or 20*e*–20*h*, can be modified for a configurable spark operation.

A configurable spark can be obtained as described in section "Operation of first embodiment, second mode of operation" above.

The ion-sense modules having configurable spark can then be operated such that the spark duration is controlled within the operating ranges as defined in FIG. 1, and described in section "Operation of first embodiment, second mode of operation" above.

Operation of second embodiment, second mode of operation

In the second embodiment shown, for the second mode of operation, each ion-sense module is designed for delivery of an ignition spark having a relatively long duration, in the range between 0.5–1.5 ms, when operated in the single sparking mode. In order not to interfere with the knock window in the upper engine speed ranges, the ion-sense module operating as a sensor circuit should be deactivated as a spark producer. If a detection circuit as shown in the ion-sense module 20*a* in FIG. 3 is used, a sequential shifting, between deactivated ion-sense modules serving one and the same combustion chamber, must be implemented by the ECM.

For example, if ion-sense module 20*a* is deactivated during the first combustion in the combustion chamber 43, then the ion-sense module 20*e* serving the other ignition plug in the same combustion chamber must be deactivated for the second combustion event in that combustion chamber.

Deactivation will thus thereafter be shifted between the ion-sense modules serving the combustion chamber in question, and between each combustion event in that combustion chamber. This is needed in order to recharge the capacitor K by the ignition pulse generated. If the charge voltage of the capacitor K is not maintained, then no ionisation current can be detected, due to lack of sufficient bias voltage at the spark plug gap.

Further Modifications

The invention is not limited to the embodiments shown. The ignition coils or system serving a spark plug not being used as a sensor, could be implemented in numerous ways. The dual-ended coils 10, 11 shown in FIG. 3, could be substituted by a single ignition coil and a conventional distributor arrangement.

If only one spark plug in each combustion chamber is used as a sensor in the system shown in FIG. 4, then the entire detection circuit K/Rm/Ze/Zd could be omitted in the ignition modules not acting as ion-sensing modules.

If the ion-sense module is completely deactivated at upper speed ranges, only acting as a silent probe or sensor, and a detection circuit as shown in FIG. 3 is used, then recharging of the capacitor K could be obtained by an external source or from the spark voltage from the other ignition coil serving the spark plug acting as actuator. Supply from the other coil could be realised by a zener-diode arrangement connecting the secondary of the spark producing coil with the capacitor. The capacitor K in the detection circuit shown in FIG. 3 needs to be recharged between successive firings, due to complete or at least partly discharge thereof during ionisation current measurements.

In the single spark mode, where one spark plug is used as a silent probe, flame propagation speed from the ignition source to the second silent spark plug can be measured, providing more feedback information from the combustion process. This information can then be used for some additional engine control strategies. The ionisation current signal provided by the non-firing spark plug is free of any blanking or interference and thus offering a simpler signal processing in order to extract additional mixture/combustion parameters.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

We claim:

1. Method for controlling ignition and ionization current measurement in a combustion engine having at least a first and second spark plug in each combustion chamber, the first and second spark plugs at least during a part of the operating range of the engine being supplied with respective ignition voltages from an ignition voltage source, and at least one of the first and second spark plugs being used as a sensor for ionization current measurement, which method comprise:

controlling an ignition voltage supplied to the spark plug in a combustion chamber acting as the sensor such that, during at least a part of the operating range of the engine, the duration of the ignition spark of the spark plug acting as the sensor is less than 50% of the spark duration of the other spark plug in the combustion chamber.

2. Method according to claim 1 wherein the ignition voltage source includes first and second ignition coils for the first and second spark plugs, respectively, at least one of the ignition coils including an ionization current detection circuit which is connected in a ground connection of a secondary winding of the ignition coil.

3. Method according to claim 2, wherein the ignition voltage supply to the spark plug acting as the sensor is controlled by configuring the ignition coil associated therewith for single spark discharge operation, and wherein the ignition coil associated with the spark plug acting as a sensor has a low impedance resulting in a spark duration less than 0.5 ms over the entire engine operating range.

4. Method according to claim 2, wherein both the first and second spark plugs in a combustion chamber produce a spark below a predetermined threshold, which threshold is determined by at least the engine speed and an optimized ignition spark advance, and wherein the spark plug acting as a sensor is deactivated as a spark producer above the predetermined threshold, thereby enabling a proper measurement of ionization current in the combustion chamber above the predetermined threshold without having the spark duration interfering with a measuring window for ionization current detection.

5. Method according to claim 4, wherein each of the first and second ignition coils includes an ionization current detection circuit, each detection circuit being connected in a ground connection of the secondary winding of its respective ignition coil and wherein between successive compression strokes in each combustion chamber both the first and second spark plugs of the combustion chamber are alternatively deactivated as spark producers above the predetermined threshold.

6. Method according to claim 5, wherein each ionization current detection circuit includes a bias voltage source applying a substantially constant bias voltage to its associated spark plug.

7. Method according to claim 6, wherein the bias voltage source is a capacitor, the capacitor being charged by a spark current developed in the secondary winding of the associated ignition coil.

8. Method according to claim 2, wherein both the first and second spark plugs in a combustion chamber are used to produce configurable sparks of variable spark duration having substantially similar duration below a predetermined threshold, which threshold is determined by at least the engine speed, and wherein the spark generated at the spark plug acting as a sensor is controlled such that the duration of the spark decreases at least dependent on increasing engine speed, thereby enabling a proper measurement of ionization current in the combustion chamber above the predetermined threshold without having the spark duration interfering with a measuring window for ionization current detection.

9. Method according to claim 2, wherein the ignition coil not having an ionization current detection circuit is a dual-ended ignition coil, wherein the ends of the secondary winding are connected to spark plugs in different combustion chambers and wherein the dual-ended ignition coil is operated to obtain a configurable spark of variable duration by repeated operation of a circuit breaker element in series with a primary winding of the dual-ended ignition coil.

10. Method according to claim 8, wherein the spark generated at the spark plug which is used as a sensor is controlled such that the duration of the spark decreases dependent on decreasing ignition advance, thereby enabling measurement of ionization current in the combustion chamber, without having the spark duration interfering with a measuring window for ionization current detection.

* * * * *

UNITED STATES PATENT AND TRADEMARK OFFICE

CERTIFICATE OF CORRECTION

PATENT NO. : 5,954,024

DATED : September 21, 1999

INVENTOR(S) : Duhr, et al.

It is certified that error appears in the above-indentified patent and that said Letters Patent is hereby corrected as shown below:

On the title page, item [73], change "Henkel Corporation. Gulph Mills, PA" to --Mecel AB and General Motors Corporation. Sweden and U.S.A.--.

Signed and Sealed this

Twenty-first Day of November, 2000

*Attest:*

Q. TODD DICKINSON

*Attesting Officer*

*Director of Patents and Trademarks*